US011454355B2

(12) United States Patent
Li

(10) Patent No.: US 11,454,355 B2
(45) Date of Patent: Sep. 27, 2022

(54) LIGHT BULB

(71) Applicant: Xiamen Longstar Lighting Co., Ltd., Fujian (CN)

(72) Inventor: Xilong Li, Fujian (CN)

(73) Assignee: Xiamen Longstar Lighting Co., Ltd., Xiamen (CN)

( * ) Notice: Subject to any disclaimer, the term of this patent is extended or adjusted under 35 U.S.C. 154(b) by 0 days.

(21) Appl. No.: 17/351,540

(22) Filed: Jun. 18, 2021

(65) Prior Publication Data

US 2022/0260216 A1 Aug. 18, 2022

(30) Foreign Application Priority Data

Feb. 18, 2021 (CN) ..... 202120378268.4

(51) Int. Cl.

| | |
|---|---|
| ***F21K 9/232*** | (2016.01) |
| ***F21V 23/04*** | (2006.01) |
| ***F21V 19/00*** | (2006.01) |
| ***F21V 17/16*** | (2006.01) |
| ***F21V 29/70*** | (2015.01) |

(52) U.S. Cl.

CPC ..... *F21K 9/232* (2016.08); *F21V 17/16* (2013.01); *F21V 19/003* (2013.01); *F21V 23/04* (2013.01); *F21V 29/70* (2015.01)

(58) Field of Classification Search

CPC ..... F21K 9/232; F21V 23/04

See application file for complete search history.

(56) References Cited

U.S. PATENT DOCUMENTS

| | | | | |
|---|---|---|---|---|
| 7,484,860 | B2 * | 2/2009 | Demarest | F21V 3/02 362/253 |
| 2017/0108204 | A1 * | 4/2017 | Wu | F21K 9/232 |
| 2018/0135819 | A1 * | 5/2018 | Grandadam | F21V 23/0435 |
| 2018/0206305 | A1 * | 7/2018 | Van Winkle | F21V 23/04 |
| 2019/0203893 | A1 * | 7/2019 | Ye | F21V 23/007 |
| 2020/0187319 | A1 * | 6/2020 | Jiang | H05B 47/19 |

* cited by examiner

*Primary Examiner* — Eric T Eide

(74) *Attorney, Agent, or Firm* — Cooper Legal Group, LLC

(57) ABSTRACT

The present disclosure discloses a light bulb comprising a housing, a light source board, and a paddle. The housing comprises an opening hole, the light source board comprises a light bead and a switch, and the light source board is disposed in the housing such that the switch corresponds to opening hole. The paddle comprises an operating member and a transmission member, the transmission member is configured to pass through the opening hole to be operatively coupled to the switch, and the operating member is configured to slide on the housing to control a turning ON and OFF of the light bead and a changing of color temperature of the light bead.

18 Claims, 5 Drawing Sheets

LIGHT BULB

RELATED APPLICATIONS

This application claims priority to Chinese patent application number 202120378268.4, filed on Feb. 18, 2021. Chinese patent application number 202120378268.4 is incorporated herein by reference.

FIELD OF THE DISCLOSURE

The present disclosure relates to a light bulb.

BACKGROUND OF THE DISCLOSURE

The traditional light bulb comprises a housing, an aluminum cup, a switch, a light source board, and a driving board. The aluminum cup is installed in the housing, the light source board is installed on the aluminum cup, the driving board is welded with the switch, and the driving board is connected to the light source board by welding. The assembly is troublesome and costly.

BRIEF SUMMARY OF THE DISCLOSURE

The present disclosure provides a light bulb with simple assembly and low cost to solve the deficiencies in the background.

In order to solve the technical problem, a technical solution of the present disclosure is as follows.

A light bulb comprises a housing, a light source board, and a paddle. The housing comprises an opening hole, the light source board comprises a light bead and a switch, and the light source board is disposed in the housing such that the switch corresponds to opening hole. The paddle comprises an operating member and a transmission member, the transmission member is configured to pass through the opening hole to be operatively coupled to the switch, and the operating member is configured to slide on the housing to control a turning ON and OFF of the light bead and a changing of color temperature of the light bead.

In a preferred embodiment, the housing comprises an outer housing and a heat dissipating cup. The outer housing comprises a mounting space in which the heat dissipating cup is configured to be disposed. The outer housing comprises the opening hole, and the heat dissipating cup comprises a notch configured to correspond to the opening hole. When the light source board is disposed on the heat dissipating cup, the switch corresponds to the notch and the opening hole.

In a preferred embodiment, the housing further comprises a light-transmitting cover, the light-transmitting cover is disposed at an opening of the mounting space, and the light bead faces the light-transmitting cover.

In a preferred embodiment, a plurality of positioning posts is disposed in the outer housing. When the heat dissipating cup is disposed in the mounting space, the plurality of positioning posts extends through and abuts the heat dissipating cup.

In a preferred embodiment, the heat dissipating cup further comprises a mounting plane through which the plurality of positioning posts extends, and the light source board is configured to be correspondingly positioned on the plurality of positioning posts.

In a preferred embodiment, the light bulb further comprises a plurality of fasteners. Each of the plurality of fasteners is correspondingly connected to each of the plurality of positioning posts to fixedly connect the light source board and the plurality of positioning posts.

In a preferred embodiment, the heat dissipating cup further comprises a heat dissipating wall extending along a circumference of the mounting plane, and the heat dissipating wall comprises the notch.

In a preferred embodiment, two sides of the operating member are respectively disposed with a clamping groove, and the two clamping grooves are configured to respectively clamp and slide on two sides of the opening hole.

In a preferred embodiment, the transmission member comprises two side panels extending into a mounting space of the housing, the switch is clamped between the two side panels, and the operating member is configured to slide to drive the two side panels to slide to control the switch.

Compared with the existing techniques, the technical solution has the following advantages.

The light source board comprises the light bead and the switch and is disposed in the housing. The switch is configured to correspond to the opening hole. The paddle comprises the operating member and the transmission member. The transmission member is configured to pass through the opening hole to be operatively coupled to the switch, and the operating member is configured to slide on the housing to control the turning ON and OFF of the light bead and the changing of color temperature of the light bead. The switch is directly disposed on the light source board, the switch directly corresponds to the opening hole, and the paddle is directly connected to the switch through the opening hole, which is easy to assemble and keeps costs low.

DETAILED DESCRIPTION OF THE EMBODIMENTS

The present disclosure will be further described below in combination with the accompanying drawings and embodiments.

Some directional terms used to describe the drawings, such as "inner", "outer", "above", "below", and other directional terms will be understood to have their normal meaning and refer to those directions involved in normal viewing of the drawings. Unless otherwise indicated, directional terms described herein substantially follow conventional directions as understood by those skilled in the art.

The terms "first", "second", and similar terms used in the present disclosure do not denote any order, quantity, or importance in the present disclosure, but are used to distinguish one component from other components.

Figure 1:
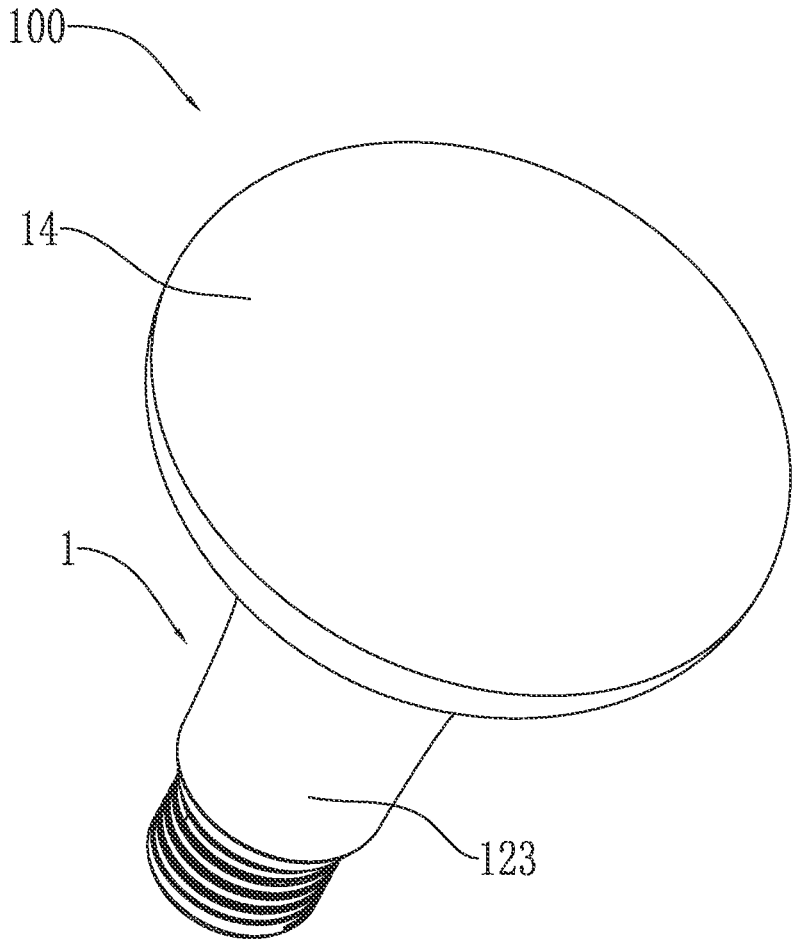
FIG. 1 illustrates a perspective view of a light bulb in a preferred embodiment of the present disclosure.
Figure 2:
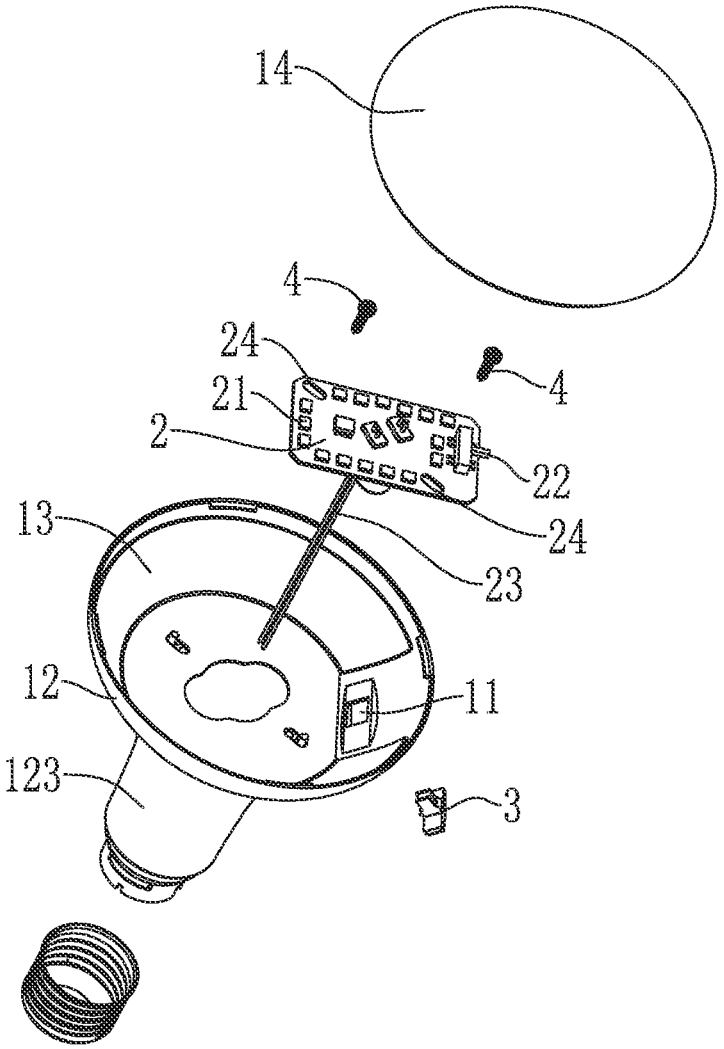
FIG. 2 illustrates an exploded view of the light bulb in the preferred embodiment of the present disclosure.
Figure 3:
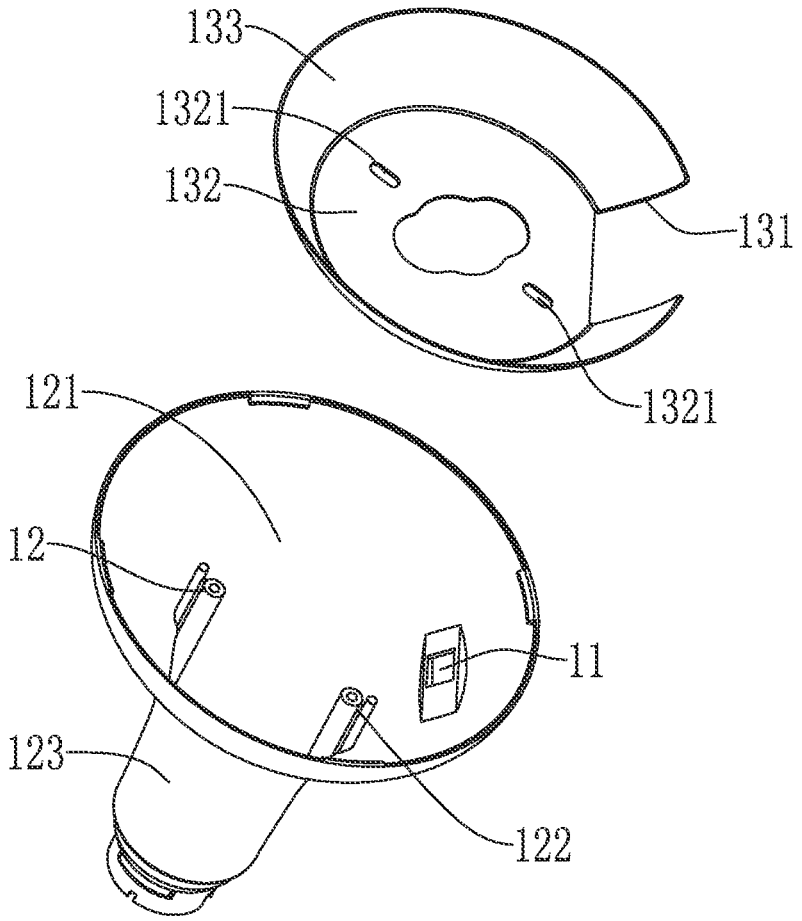
FIG. 3 illustrates an exploded view of an outer housing and a heat dissipating cup in the preferred embodiment of the present disclosure.
Figure 4:
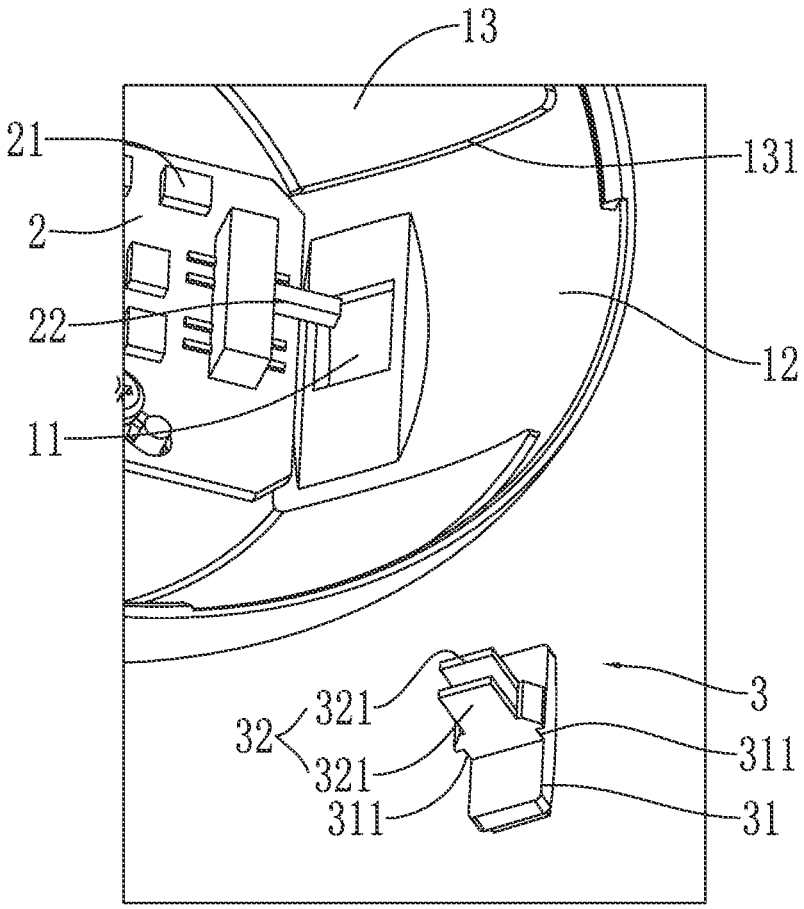
FIG. 4 illustrates an exploded view of a paddle in the preferred embodiment of the present disclosure during an installation process.
Figure 5:
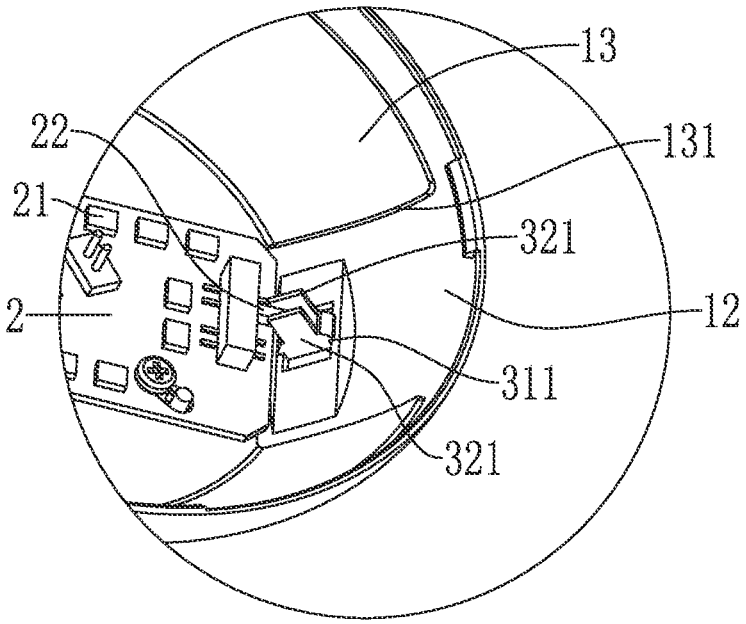
FIG. 5 illustrates a perspective view of the paddle in the preferred embodiment of the present disclosure after the paddle has been installed.

Referring to FIGS. 1-5, a light bulb 100 comprises a housing 1, and the housing 1 comprises an opening hole 11. The light bulb 100 further comprises a light source board 2 disposed in the housing 1. The light source board 2 comprises a light bead 21 and a switch 22, and the switch 22 is configured to correspond to the opening hole 11. The light bulb 100 further comprises a paddle 3, and the paddle 3 comprises an operating member 31 and a transmission member 32. The operating member 31 is slidably disposed on the housing 1. The transmission member 32 is configured to pass through the opening hole 11 to be operatively coupled to the switch 22. The operating member 31 is configured to slide on the housing 1 to control a turning ON and OFF of the light bead 21 and a changing of color temperature of the light bead 21.

Two sides of the operating member 31 are respectively disposed with a clamping groove 311, and the two clamping grooves 311 are configured to respectively clamp and slide on two sides of the opening hole 11. The transmission member 32 comprises two side panels 321 extending into a mounting space 121 of the housing 1. The switch 22 is clamped between the two side panels 321, and the operating member 31 is configured to slide to drive the two side panels 321 to slide to control the switch 22.

The housing 1 comprises an outer housing 12 and a heat dissipating cup 13, and the outer housing 12 comprises the mounting space 121, and the heat dissipating cup 13 is configured to be disposed in the mounting space 121. The outer housing 12 comprises the opening hole 11, and the heat dissipating cup 13 comprises a notch 131 configured to correspond to opening hole 11. When the light source board 2 is disposed on the heat dissipating cup 13, the switch 22 corresponds to the notch 131 and the opening hole 11. The housing 1 further comprises a light-transmitting cover 14 disposed at an opening of the mounting space 121, and the light bead 21 of the light source board 2 faces the light-transmitting cover 14. In this embodiment, the heat dissipating cup 13 is made of aluminum.

A plurality of positioning posts 122 is disposed in the outer housing 12. When the heat dissipating cup 13 is disposed in the mounting space 121, the plurality of positioning posts 122 extends through and abuts the heat dissipating cup 13.

The outer housing 12 comprises a connecting portion 123 facing away from the mounting space 121, and a distal end of the connecting portion 123 is configured to be connected to a power source. The light source board 2 further comprises a wire 23, and the wire 23 passes through the heat dissipating cup 13 and extends to be connected to the distal end of the connecting portion 123.

The heat dissipating cup 13 further comprises a mounting plane 132 through which the plurality of positioning posts 122 extends. The light source board 2 is configured to be correspondingly positioned on the plurality of positioning posts 122. The mounting plane 132 comprises a plurality of through holes 1321 corresponding to the plurality of positioning posts 122. The light source board 2 comprises a plurality of mounting holes 24 corresponding to the plurality of positioning posts 122, and the plurality of positioning posts 122 extends through the plurality of through holes 1321 and the plurality of mounting holes 24 in sequence. The heat dissipating cup 13 comprises a heat dissipating wall 133 extending along a circumference of the mounting plane 132, and the heat dissipating wall 133 comprises the notch 131.

The light bulb 100 comprises a plurality of fasteners 4, and each of the plurality of fasteners 4 is correspondingly connected to each of the plurality of positioning posts 122 to fixedly connect the light source board 2 and the plurality of positioning posts 122. In this embodiment, the plurality of fasteners 4 is a plurality of screws, and the plurality of screws passes through the plurality of mounting holes 24 and the plurality of through holes 1321 to be fixedly connected to the plurality of positioning posts 122.

During an installation process, the heat dissipating cup 13 is disposed in the mounting space 121, and the plurality of positioning posts 122 passes through the plurality of through holes 1321 of the heat dissipating cup 13. The light source board 2 is disposed on the mounting plane 132 of the heat dissipating cup 13, and the plurality of positioning posts 122 passes through the plurality of mounting holes 24 of the light source board 2. The switch 22 of the light source board 2 corresponds to the opening hole 11, the paddle 3 is connected to the outer housing 12 and operatively coupled to the switch 22, and the light-transmitting cover 14 is connected to the opening of the mounting space 121.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A light bulb, comprising:
a housing,
a light source board, and
a paddle, wherein:
the housing comprises an outer housing and a heat dissipating cup,
the outer housing comprises a mounting space in which the heat dissipating cup is configured to be disposed,
the outer housing comprises an opening hole,
the heat dissipating cup comprises a mounting plane and a heat dissipating wall extending along a circumference of the mounting plane,
the light source board is disposed on the mounting plane,
the heat dissipating wall comprises a notch configured to correspond to the opening hole,
a front surface of the light source board comprises a light bead and a switch,
the light source board is disposed in the housing such that the switch corresponds to opening hole,
the paddle comprises an operating member and a transmission member,
the transmission member is configured to pass through the opening hole to be operatively coupled to the switch, and
the operating member is configured to slide on the housing to control a turning ON and OFF of the light bead and a changing of color temperature of the light bead.

2. The light bulb according to claim 1, wherein
when the light source board is disposed on the heat dissipating cup, the switch corresponds to the notch and the opening hole.

3. The light bulb according to claim 2, wherein:
the housing further comprises a light-transmitting cover,
the light-transmitting cover is disposed at an opening of the mounting space, and
the light bead faces the light-transmitting cover.

4. The light bulb according to claim 2, wherein:
a plurality of positioning posts is disposed in the outer housing, and when the heat dissipating cup is disposed in the mounting space, the plurality of positioning posts extends through and abuts the heat dissipating cup.

5. The light bulb according to claim 4, wherein:

the plurality of positioning posts extends through the mounting plane, and the light source board is configured to be correspondingly positioned on the plurality of positioning posts.

6. The light bulb according to claim 5, comprising a plurality of fasteners, wherein:

each of the plurality of fasteners is correspondingly connected to each of the plurality of positioning posts to fixedly connect the light source board and the plurality of positioning posts.

7. The light bulb according to claim 1, wherein:

two sides of the operating member are respectively disposed with a clamping groove, and the two clamping grooves are configured to respectively clamp and slide on two sides of the opening hole.

8. The light bulb according to claim 7, wherein:

the transmission member comprises two side panels extending into the mounting space, the switch is clamped between the two side panels, and the operating member is configured to slide to drive the two side panels to slide to control the switch.

9. The light bulb according to claim 2, wherein:

two sides of the operating member are respectively disposed with a clamping groove, and the two clamping grooves are configured to respectively clamp and slide on two sides of the opening hole.

10. The light bulb according to claim 9, wherein:

the transmission member comprises two side panels extending into the mounting space, the switch is clamped between the two side panels, and the operating member is configured to slide to drive the two side panels to slide to control the switch.

11. The light bulb according to claim 3, wherein:

two sides of the operating member are respectively disposed with a clamping groove, and the two clamping grooves are configured to respectively clamp and slide on two sides of the opening hole.

12. The light bulb according to claim 11, wherein:

the transmission member comprises two side panels extending into the mounting space, the switch is clamped between the two side panels, and the operating member is configured to slide to drive the two side panels to slide to control the switch.

13. The light bulb according to claim 4, wherein:

two sides of the operating member are respectively disposed with a clamping groove, and the two clamping grooves are configured to respectively clamp and slide on two sides of the opening hole.

14. The light bulb according to claim 13, wherein:

the transmission member comprises two side panels extending into the mounting space, the switch is clamped between the two side panels, and the operating member is configured to slide to drive the two side panels to slide to control the switch.

15. The light bulb according to claim 5, wherein:

two sides of the operating member are respectively disposed with a clamping groove, and the two clamping grooves are configured to respectively clamp and slide on two sides of the opening hole.

16. The light bulb according to claim 15, wherein:

the transmission member comprises two side panels extending into the mounting space, the switch is clamped between the two side panels, and the operating member is configured to slide to drive the two side panels to slide to control the switch.

17. The light bulb according to claim 6, wherein:

two sides of the operating member are respectively disposed with a clamping groove, and the two clamping grooves are configured to respectively clamp and slide on two sides of the opening hole.

18. The light bulb according to claim 17, wherein:

the transmission member comprises two side panels extending into the mounting space, the switch is clamped between the two side panels, and the operating member is configured to slide to drive the two side panels to slide to control the switch.

* * * * *